US006951280B1

(12) United States Patent
Lee

(10) Patent No.: US 6,951,280 B1
(45) Date of Patent: Oct. 4, 2005

(54) GUITAR CASE THAT DOUBLES AS A GUITAR STAND

(76) Inventor: Earl Bud Lee, 1705 Portland Ave., Nashville, TN (US) 37212

( * ) Notice: Subject to any disclaimer, the term of this patent is extended or adjusted under 35 U.S.C. 154(b) by 0 days.

(21) Appl. No.: 09/920,415

(22) Filed: Aug. 1, 2001

(51) Int. Cl.[7] ..... A45C 11/00
(52) U.S. Cl. ..... 206/314; 206/14; 206/45.2
(58) Field of Search ..... 206/14, 314, 45.2, 206/45.23, 45.24; 16/365, 366; 248/443; 220/810, 820, 824

(56) References Cited

U.S. PATENT DOCUMENTS 1,352,814 A * 9/1920 Kirk ..... 206/314
1,988,718 A * 1/1935 Cook et al. ..... 206/314
3,637,070 A * 1/1972 Friedman ..... 206/314
4,147,254 A 4/1979 Bruce ..... 206/314
4,151,909 A * 5/1979 Markov ..... 206/14
4,223,785 A 9/1980 Jacques ..... 206/314
4,474,290 A 10/1984 DeMato ..... 206/314
5,590,771 A 1/1997 Cota ..... 206/314
5,833,051 A 11/1998 Tiefenbrun ..... 206/14
6,145,801 A 11/2000 Herring, Jr. ..... 248/463

* cited by examiner

*Primary Examiner*—David T. Fidei

(57) ABSTRACT

An instrument case is disclosed having a case body having a top edge. A cover fits over the case body and has a top inner and outer edge. A hinge, having two axes of rotation, connects the cover to the case body. One axis is substantially coincident with the edge of the of the case body and the other axis is substantially coincident with either edge of the top of the cover. When the cover is rotated to an open position, the cover supports the case body and allows the case to function as an instrument stand.

25 Claims, 5 Drawing Sheets

GUITAR CASE THAT DOUBLES AS A GUITAR STAND

FIELD OF THE INVENTION

The present invention relates generally to carrying cases for stringed musical instruments, such as guitars.

BACKGROUND OF THE INVENTION

When a musician of a stringed musical instrument performs, he has at least two concerns. One is where to put his carrying case, which is usually rather large and bulky. The other is where to store the instrument when not it is not in use so that the instrument is both protected from disturbances yet easily accessible; the necessity for accessibility is extremely important for the musician who plays two or more instruments during one song.

The musician's sensitivity to both of these problems is heightened when the performance area is small and must be shared with other musicians who also play stringed musical instruments.

Additionally, the musician is further encumbered when he is forced to carry both his instrument and an instrument stand. Obviously, if the musician could reduce the number of items that he had to carry, it would be advantageous to him.

Several devices disclosed in issued patents seek to address these problems. For example, U.S. Pat. No. 4,147,254 to Bruce (the '254 patent) discloses a combination carrying case and instrument stand. The case has a pair of front panels that are each hingedly connected along the side to a side panel. Each side panel is then in turn hingedly connected to a back panel. The case can stand upright and serve as an instrument stand when the front and side panels are moved from the closed position to the open position. The device taught by the '254 patent is disadvantageous, however, because the front cover is formed of a double panel. Also, it does not incorporate a conventional carrying case, so manufacturing is more complicated than if a conventional carrying case were adapted for use as an instrument stand.

U.S. Pat. No. 4,223,785 to Jacques (the '785 patent) discloses a combination case and instrument stand. The case has a body portion and a neck portion and the lower end thereof is provided with a flat bottom supporting surface. A pair of doors opens and close upon themselves to define an instrument display position and an instrument carrying position. The device taught by the '785 patent is disadvantageous, however, because the front cover is not formed of a single panel, rather it has a plurality of hinges positioned along a longitudinal axis of the front panel. Also, it does not incorporate a conventional carrying case, so manufacturing is more complicated than if a conventional carrying case were adapted for use as an instrument stand.

U.S. Pat. No. 5,833,051 to Tiefenbrun et al. (the '051 patent) discloses a guitar case that comprises a plurality of inflatable bladders for defining a compartment for receiving a guitar and for resiliently supporting the guitar placed in the compartment. An instrument stand position is formed by inflating a balloon (76), which, when inflated, allows the case body to rest in a slightly inclined position allowing the user relatively quick access to the instrument. The use of balloons, however, is disadvantageous as they are subject to punctures, which may render them inoperable and require down-time while repairs are made.

U.S. Pat. No. 6,145,801 to Herring, Jr. (the '801 patent) discloses a folding instrument case stand that is attachable to the instrument case and supports the case in an upright, tilted position. The stand has spring-loaded diverging legs that are pivotal relative to a central frame between a folded and an extended position. When the legs are in the folded configuration, the stand can be transported with the instrument case. When in the extended position, the opened case functions as an instrument stand.

What is needed, then, is a free-standing instrument case that is easily converted to an instrument stand, which utilizes a conventional stringed instrument case, which has a front cover formed from a single panel, which is simple and easy to use, and which is relatively inexpensive to manufacture.

SUMMARY OF THE INVENTION

Accordingly, it is an object of the present invention to provide a multi-purpose instrument case.

It is another object of the present invention to provide an instrument carrying case that protects the instrument while it is being transported, stored or otherwise put aside during a period of non-use.

It is yet another object of the present invention to provide an instrument carrying case that may also function as an instrument stand.

It is still another object of the present invention to provide a combination instrument carrying case and instrument stand that is light-weight and easy to operate.

To overcome the deficiencies of the prior art and to achieve the objects and advantages discussed above, a stringed musical instrument case is disclosed that comprises a case body defining an internal cavity dimensioned for receipt of an instrument, such as a guitar. The case body has a back and a top that meet to form an edge.

A single-paneled cover is sized and shaped to cooperate with the case body to cover the internal cavity of the case body. The cover has a top that has a plurality of edges, including an inner and outer edge.

A hinge hingedly connects the single-paneled cover to the case body. Rotation of the cover about the hinge moves the cover between an open and a closed position. The open position defines a musical instrument stand position and the closed position defines a musical instrument carrying position.

In the most preferred embodiment, a double hinge is used to connect the case body and cover. The hinge comprises at least two axes of rotation: one axis of rotation is substantially adjacent to or coincident with the edge of the top of the case body and the second axis of rotation substantially adjacent to either the inner edge or the outer edge of the top of the cover.

If the inner edge of the top of the cover is used, then the rotation of the cover about the hinge causes the hinge plate to extend downward from the back of the case body at an acute angle relative to the back of the case body and causes the cover to lie at an angle relative to the back of the case body.

If the outer edge of the cover is used, then the rotation of the cover about the hinge causes the hinge plate to lie substantially adjacent to the back of the case body and causes the cover to lie at an angle relative to the back of the case body.

Regardless of whether the inner edge or the outer edge of the cover is used to support the axis of rotation, the musical instrument case of the present invention may be rotated to an open position to create an easel-type structure, where the cover serves as a leg to support the case body. Thus, a musician can then place the instrument in the cavity of the case body pending usage. While the instrument is placed in the cavity of the case body, it is easily accessible to the musician and is protected from bumps or other mishaps. As a result, the carrying case of the present invention functions as an instrument stand.

Advantageously, the combination carrying case and instrument stand of the present invention utilizes a conventional stringed instrument carrying case. As such, the present invention has widespread adaptability. Further, the use of the double hinge renders the case of the present invention easy to assemble and relatively inexpensive to manufacture.

DESCRIPTION OF THE PREFERRED EMBODIMENTS

Figure 2:
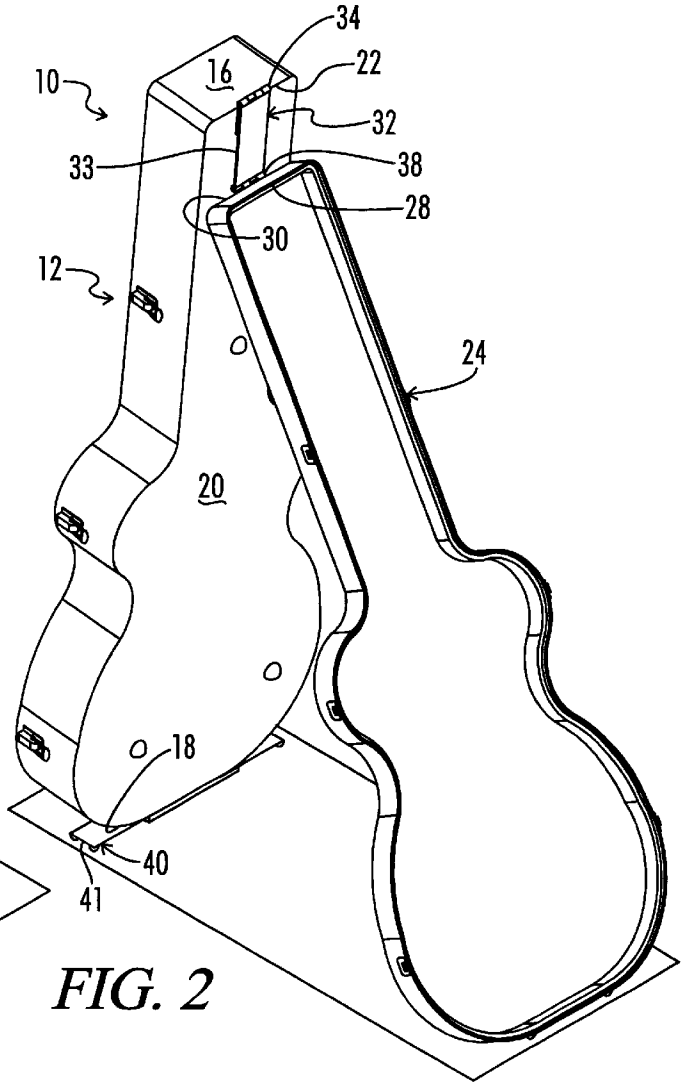
FIG. 2 is an isometric back view of the guitar carrying case shown in FIG. 1.

Referring to the drawings in detail, a case for a musical instrument, constructed in accordance with the present invention, is shown and generally designated by the reference numeral 10. It should be noted for the sake of clarity that not all of the components and parts of instrument case 10 are shown and/or marked in all the drawings. Further, the terms "top" and "bottom" refer to the case 10 when it is in the orientation shown in FIGS. 1–5.

A preferred embodiment for a case 10 for a musical instrument is shown in FIGS. 1–5. The present invention is shown for use with a stringed musical instrument, such as a guitar, for the sake of convenience only. It should be understood that the present invention may be adapted for any stringed musical instrument, such as a banjo, and may be adapted, in general, to any type of musical instrument, whether stringed or not, where the musician desires to have the instrument carrying case also function as a musical instrument stand.

Figure 1:
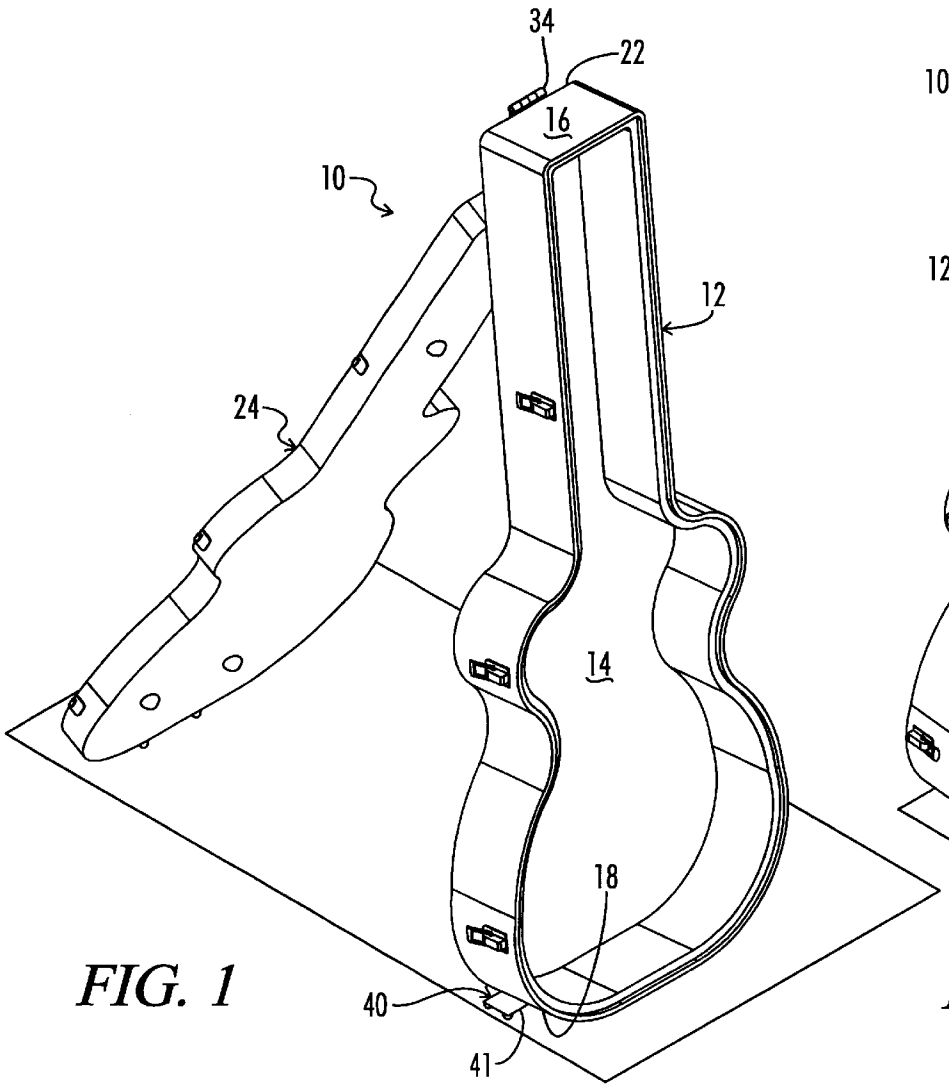
FIG. 1 is an isometric front view of a guitar carrying case constructed in accordance with the present invention, which when in the open position as shown, functions as an instrument stand.

Referring in detail to FIGS. 1–2, the case 10 comprises case body 12 defining an internal cavity 14 (best shown in FIG. 1) dimensioned for receipt of a stringed musical instrument (not shown). The case body 12 has a top 16, a bottom 18 positioned opposite the top 16, and a back 20 extending therebetween. The top 16 and back 20 of the case body 12 meet at an edge 22. See FIGS. 1–5.

A cover 24 is sized and shaped to cooperate with the case body 12 to cover the internal cavity 14 of the case body 12. The cover 24 may take on any size and shape so long as it suitably cooperates with the case body 12 to cover the internal cavity 14 of the case body 12. In the most preferred embodiment, the cover 24 is a single-paneled cover, that is, it is made from one, substantially uniform, rigid piece of material and does not have a central or longitudinal axis so it is not flexible or foldable thereabout.

Figure 5:
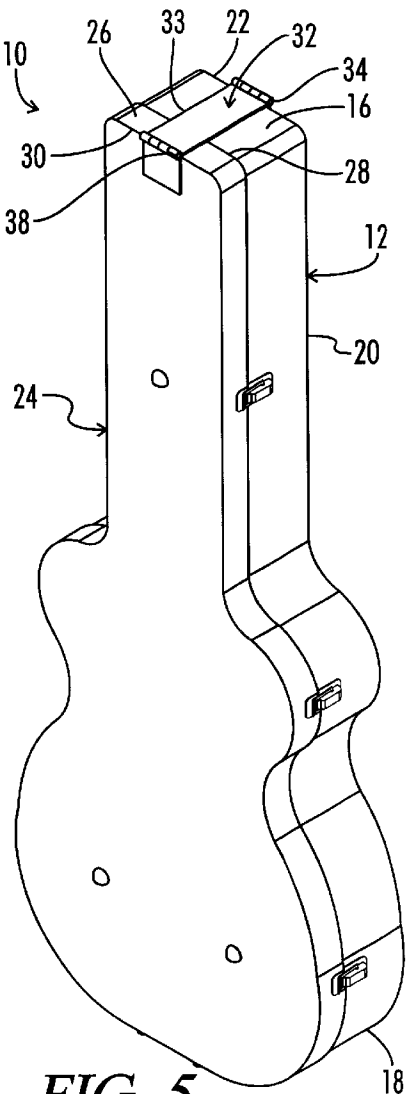
FIG. 5 is an isometric view of the guitar carrying case shown in FIG. 3.
Figure 4:
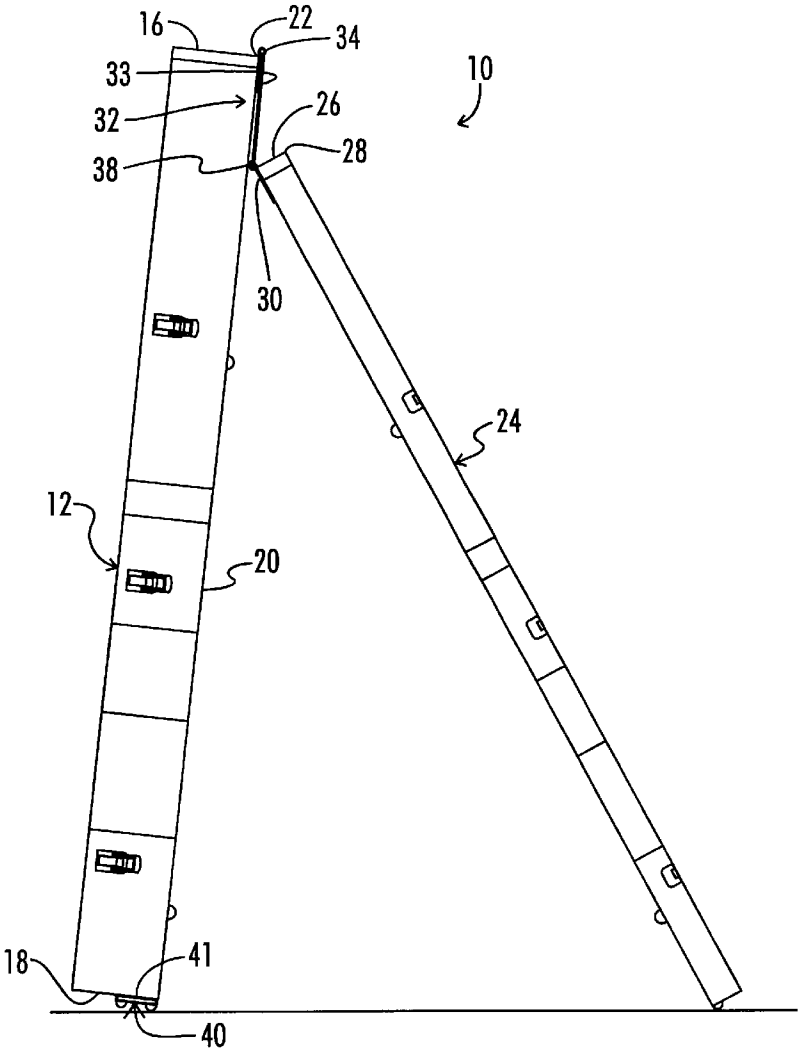
FIG. 4 is a side view of the guitar carrying case shown in FIG. 1.

The cover 24 has a top 26, which preferably has a plurality of edges; in the most preferred embodiment, the top is substantially rectangular and has four edges thereabout, including an inner and outer edge 28, 30, which is best shown in FIGS. 4, 5.

Referring to FIGS. 2–5, a hinge 32 hingedly connects the cover 24 to the case body 12. Most preferably, hinge 32 is a double hinge having a hinge plate 33 which has opposing axes of rotation 34, 38. One axis of rotation 34 is substantially adjacent to or coincident with the edge 22 of the top 16 and back 20 of the case body 12 and the second axis of rotation 38 is substantially adjacent to or coincident with either the inner edge 28 (FIGS. 6–10) or the outer edge 30 (FIGS. 1–5) of the top 26 of the cover 24.

As used herein, the terms "adjacent to" and "coincident with" refer to the location of the axes 34, 38 of the hinge 32. Because the hinge 32 has dimensions, it is physically impossible to place the hinge 32 at the "exact" edge 22 formed by the back 20 and top 16 of the case body 12, and at the "exact" inner edge 28 or outer edge 30 of the top 26 of the cover 24. Therefore, the present invention 10 contemplates placement of the axes of rotation 34, 38 as close to the edges 22, 28, 30 as possible given the dimensions of the hinge 32.

Referring again to FIGS. 1–5, rotation of the cover 24 about the hinge 32 moves the cover 24 between an open (FIGS. 1–2, 4) and closed (FIGS. 3, 5) position. The closed position defines a musical instrument carrying position. The open position defines a musical instrument stand position.

One axis of rotation 38 of the hinge 32 may be positioned adjacent to or coincident with either the outer edge 30 of the top 26 of the cover 24 (FIGS. 1–5) or the inner edge 28 of the top 26 of the cover 24 (FIGS. 6–10). The designation of "inner" edge and "outer" edge refers to the edge chosen for the location of the axis of rotation and its position relative to the case body 12, when the case 10 (FIGS. 1–5), 10A (FIGS. 6–10) is in the closed position. For example, referring to FIG. 5, edge 30 is adjacent to the hinge's axis of rotation 38 and is deemed the "outer" edge because it is the most remote edge relative to the case body 12 when the case 10 is in the closed, or instrument carrying, position.

Figure 3:
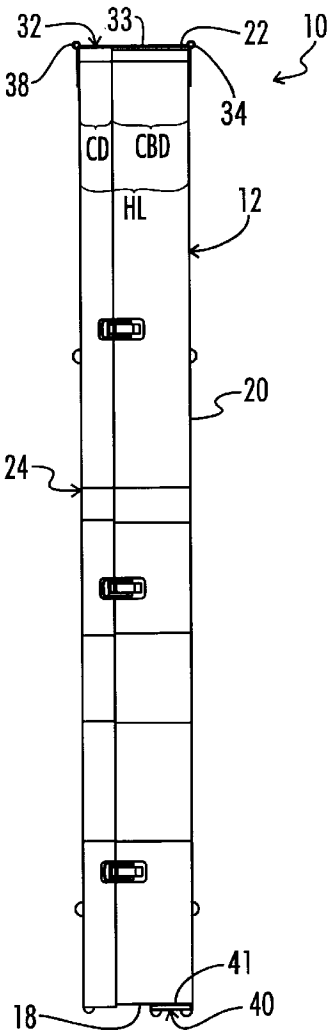
FIG. 3 is a side view of the guitar carrying case shown in FIG. 1 in the closed position.

Referring again to FIGS. 2, 4, when the axis of rotation 38 is positioned adjacent to or coincident with the outer edge 30 of the cover 24, hinge plate 33 lies substantially adjacent to the back 20 of the case body 12 and the cover 24 lies at an angle relative to the back 20 of the case body 12 and serves to support the case body 12 so that the case body 12 defines a musical instrument stand position. In this embodiment, when the cover 24 is moved to the closed position, the hinge plate 33 has a length substantially equal to the combined depth of the top of the cover and the top of the case body 12. This is best illustrated in FIG. 3. The length of the hinge plate is designated by HL; the depth of the top 16 of the case body 12 is designated by CBD and the depth of the top 26 of the cover 24 is shown as CD.

FIGS. 6–10 illustrate another preferred embodiment, where like elements are denoted with an "A" suffix. In this embodiment, one axis of rotation 56 of hinge 50 is positioned adjacent to or coincident with the inner edge 28A of the top 26A of the cover 24A and the other axis of rotation 54 is adjacent to or coincident with the edge 22A of the case body 12A formed by the back 20A and top 26A of the case body 12A. In the open position (FIGS. 6, 9), hinge plate 52 extends downward from the back 20A of the case body 12A at an acute angle relative to the back 20A of the case body 12A and the cover 24A lies at an angle relative to the back 20A of the case body 12A. When the cover 24A is moved to the closed position (FIGS. 7–8), the hinge plate 52 has a length HL substantially equal to the depth of the top 16A of the case body 12A, which is designated CBD. See FIG. 7.

Figure 8:
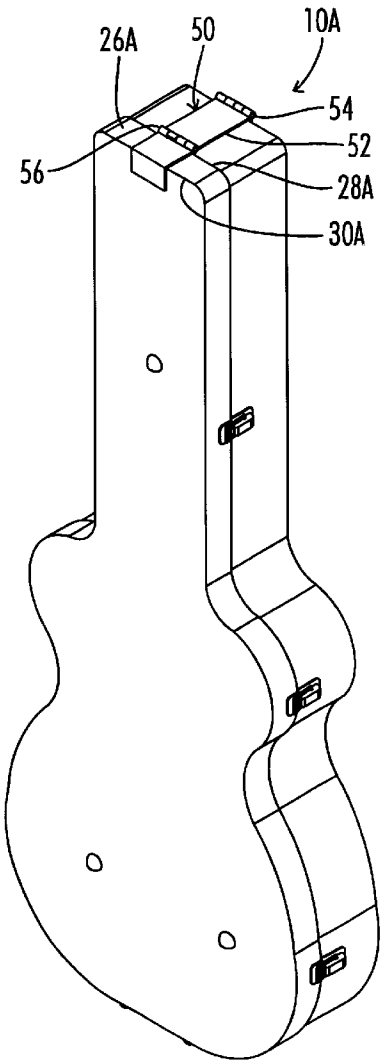
FIG. 8 is an isometric view of the guitar carrying case shown in FIG. 7.
Figure 7:
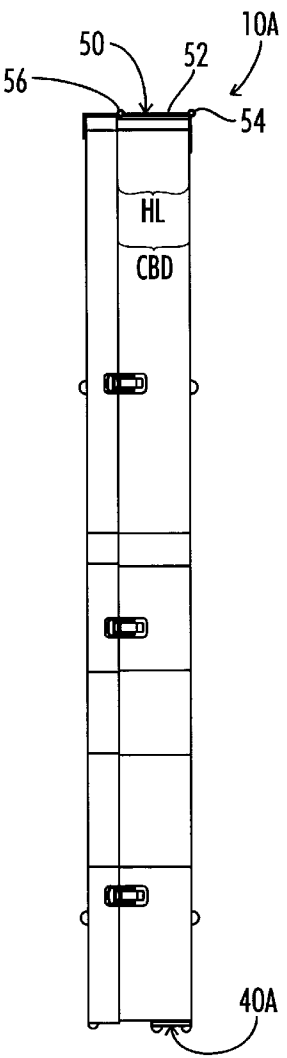
FIG. 7 is a side view of the guitar carrying case shown in FIG. 6 in the closed position.
Figure 6:
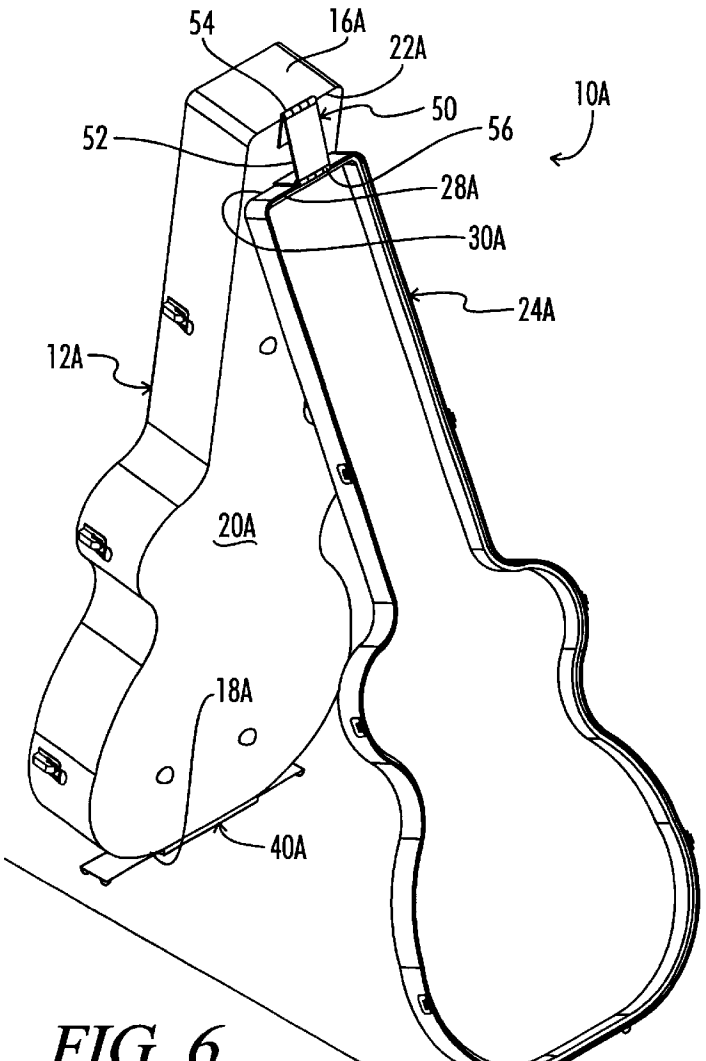
FIG. 6 is an isometric back view of another preferred embodiment of a guitar carrying case constructed in accordance with the present invention, showing the case in the open position.
Figure 10:
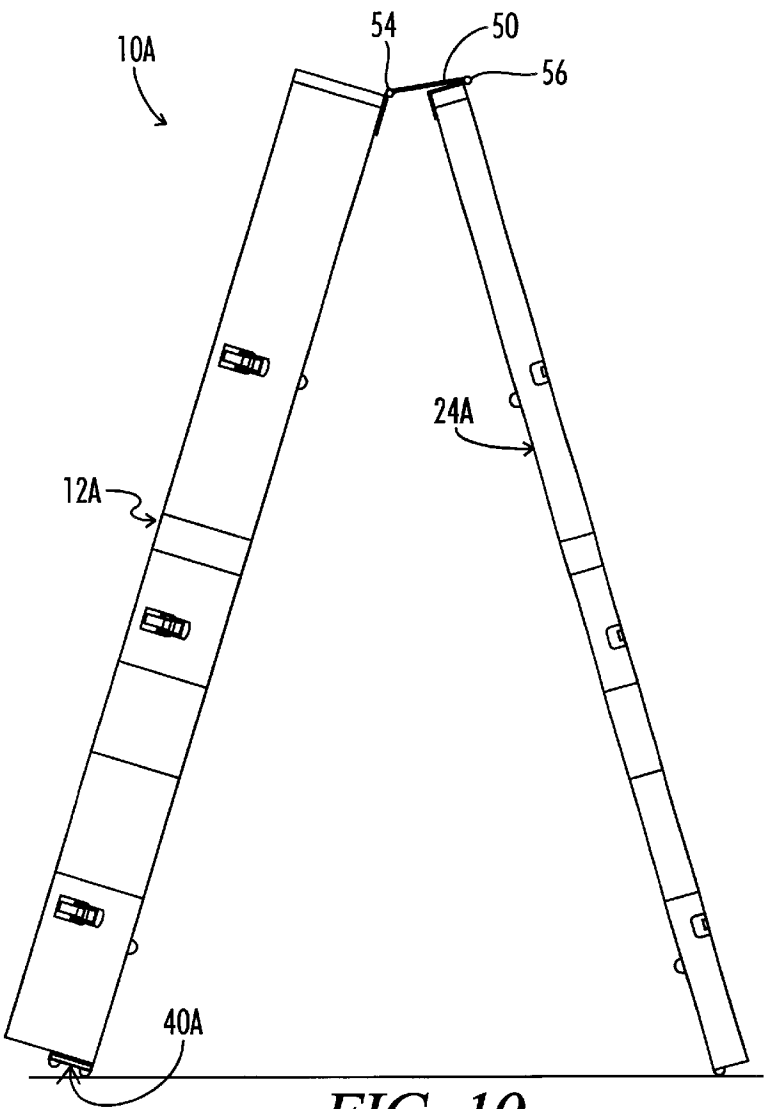
FIG. 10 is a side view of the guitar carrying case in a position between the closed and open positions.
Figure 9:
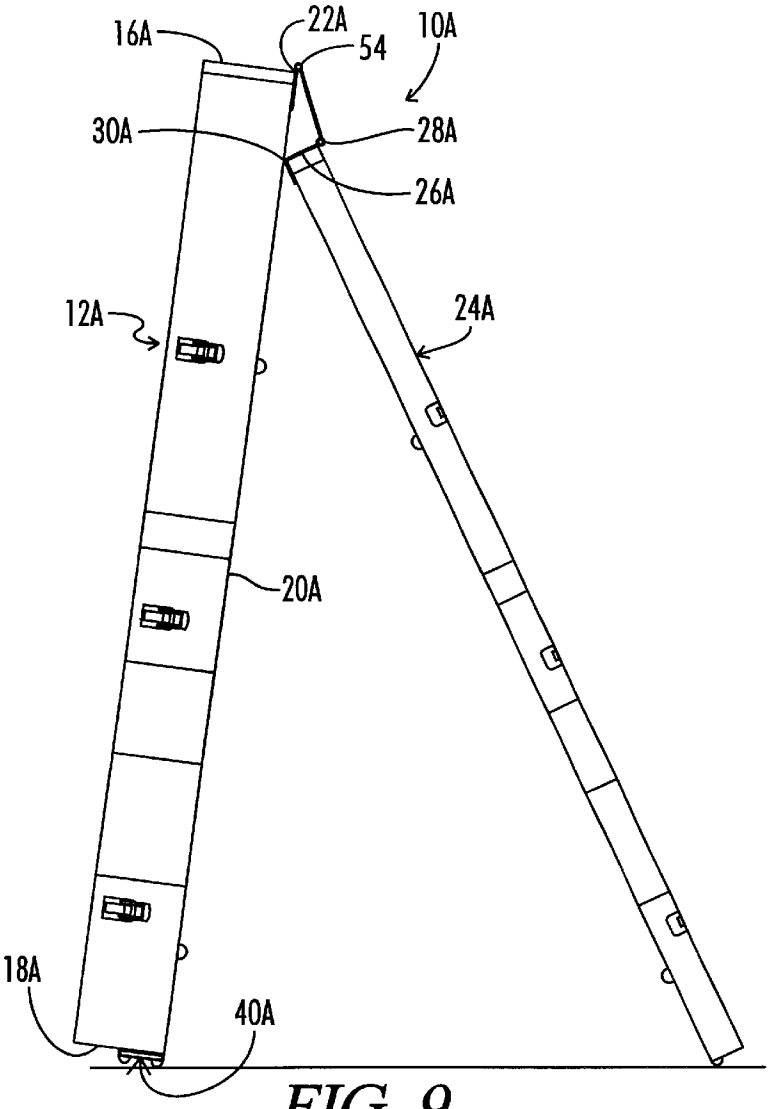
FIG. 9 is a side view of the guitar carrying case shown in FIG. 6.

FIG. 10 shows the cover 24A as it is moved between the open position (FIGS. 6, 9) and the closed position (FIGS. 7–8).

Figure 12:
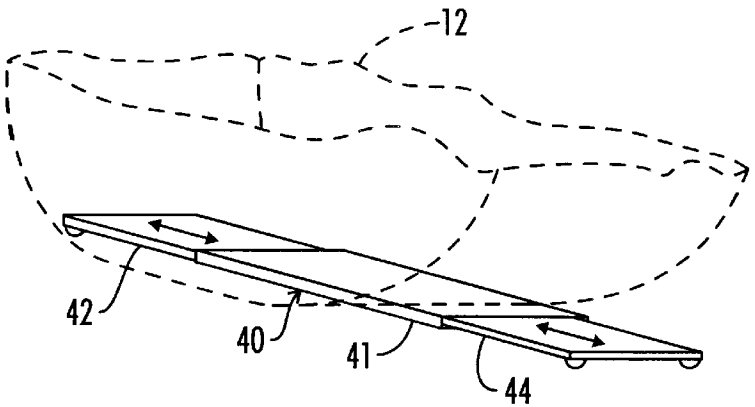
FIG. 12 is an isometric view of the base shown in FIG. 11, in the extended position.
Figure 11:
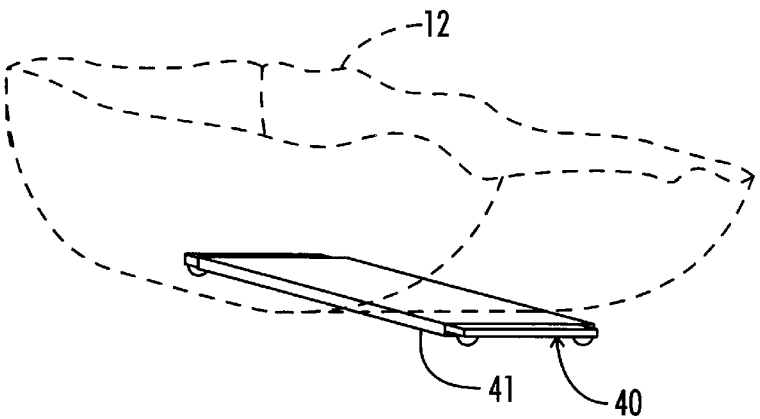
FIG. 11 is an isometric view of a base used to stabilize the guitar carrying case, wherein the base is in the unextended position and portions of the guitar carrying case are shown in dashed lines.
Figure 13:
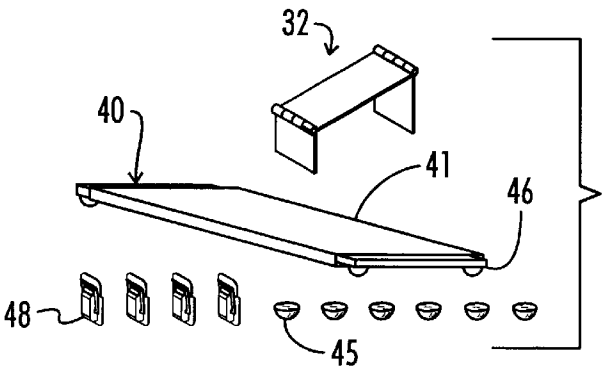
FIG. 13 is an isometric view of a double hinge, a base (in the unextended position), multiple latches and multiple protective end pieces for attaching to feet of the base.

A base 40, 40A having a base plate 41 is fixed to the bottom 18 of the case body 12, 12A for stabilizing the case body 12, 12A when the cover 24, 24A is moved to the musical instrument stand position. See FIGS. 1–4, 6–7, 9–10, 11–13. As best shown in FIG. 12, base 40, 40A comprises at least one extension member 42 and preferably comprises two extension members 44, which are slidably connected to the base plate 41, 41A, and movable relative thereto as indicated by the arrows. The extension members are movable between an extended position (best shown in FIG. 12) and a stored position (best shown in FIGS. 11, 13). When moved to the extended position, the extension members 42, 44 provide a greater surface area upon which the case body 12 may rest. As a result, the extension members 42, 44, when extended, increase the stability of the case body 12 when the cover 24 is moved to the musical instrument stand position. Protective covers, such as 45 may be positioned over the feet such as 46 of the base plate 41. See FIG. 13.

The case 10, 10A further comprises a plurality of latches, such as 48, which are known in the art, for removably connecting the cover 24 to the case body 12 when the cover 24 is moved to the musical instrument carrying position. See FIG. 13.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. A case for a musical instrument, comprising:

a case body defining an internal cavity dimensioned for receipt of an instrument;

a cover sized and shaped to cooperate with the case body to cover the internal cavity of the case body; and a hinge for hingedly connecting the cover to the case body, wherein rotation of the cover about the hinge moves the cover between an open and a closed position, said hinge permitting rotation of said cover more than 180° relative to said case body, the open position defining a musical instrument stand position and the closed position defining a musical instrument carrying position.

2. A case for a musical instrument, comprising:

a case body defining an internal cavity dimensioned for receipt of an instrument;

a cover sized and shaped to cooperate with the case body to cover the internal cavity of the case body; and a hinge for hingedly connecting the cover to the case body, wherein rotation of the cover about the hinge moves the cover between an open and a closed position, the open position defining a musical instrument stand position and the closed position defining a musical instrument carrying position, the case body having a first end, the case further comprising a base fixed to the first end of the case body for stabilizing the case body when the cover is moved to the musical instrument stand position.

3. The case of claim 2, the base comprising at least one extension member, slidably connected to the base, and movable relative thereto, to increase the stability of the case body when the cover is moved to the musical instrument stand position.

4. A case for a musical instrument, comprising:

a case body defining an internal cavity dimensioned for receipt of an instrument;

a cover sized and shaped to cooperate with the case body to cover the internal cavity of the case body; and a hinge for hingedly connecting the cover to the case body, wherein rotation of the cover about the hinge moves the cover between an open and a closed position the open position defining a musical instrument stand position and the closed position defining a musical instrument carrying position, the case body having a back and a second end that meet at an edge; the cover having a first end, the first end having an inner and outer edge; the hinge comprising at least two axes of rotation, one axis of rotation substantially adjacent to the edge of the case body and the second axis of rotation substantially adjacent to the inner edge of the single-paneled cover.

5. A case for a musical instrument, comprising:

a case body defining an internal cavity dimensioned for receipt of an instrument;

a cover sized and shaped to cooperate with the case body to cover the internal cavity of the case body; and a hinge for hingedly connecting the cover to the case body, wherein rotation of the cover about the hinge moves the cover between an open and a closed position, the open position defining a musical instrument stand position and the closed position defining a musical instrument carrying position, the case body having a back and a second end that meet at an edge; the cover having a first end, the first end having an inner and an outer edge; the hinge comprising at least two axes of rotation, one axis of rotation substantially adjacent to the edge of the case body and the second axis of rotation substantially adjacent to the outer edge of the cover.

6. An instrument case for a stringed musical instrument, comprising:

a case body defining an internal cavity dimensioned for receipt of a stringed musical instrument, the case body having a back and a top that meet at an edge;

a cover sized and shaped to cooperate with the case body to cover the internal cavity of the case body, the cover having a top, the top having an inner and an outer edge; and a hinge having two axes of rotation for hingedly connecting the top of the cover to the top of the case body, one axis of rotation substantially coincident with the edge of the of the case body and the other axis of rotation substantially coincident with one of the edges of the top of the cover, wherein rotation of the cover about the axes of rotation moves the cover between an open and a closed position, the open position defining a musical instrument stand position and the closed position defining a musical instrument carrying position.

7. The instrument case of claim 6, wherein the axis of rotation of the hinge is substantially coincident with the inner edge of the top of the cover.

8. The instrument case of claim 6, wherein the axis of rotation of the hinge is substantially coincident with the outer edge of the top of the cover.

9. The instrument case of claim 6, the case body having a bottom opposite the top, the instrument case further comprising a base fixed to the bottom of the case body for stabilizing the case body when the cover is moved to the musical instrument stand position.

10. The instrument case of claim 9, the base comprising at least one extension member, slidably connected to the base, and movable relative thereto, to increase the stability of the case body when the cover is moved to the musical instrument stand position.

11. The instrument case of claim 10 further comprising a plurality of latches for removably connecting the cover to the case body when the cover is moved to the musical instrument carrying position.

12. A stringed musical instrument case, comprising:

a case body defining an internal cavity dimensioned for receipt of a stringed musical instrument;

a cover sized and shaped to cooperate with the case body to cover the internal cavity of the case body; and a hinge for hingedly connecting the cover to the case body, wherein rotation of the cover about the hinge moves the cover between an open and a closed position, wherein in the open position the cover supports the case body so that the case body defines a tilted musical instrument stand, wherein the closed position defines a musical instrument carrying position.

13. The stringed musical instrument case of claim 12, wherein the cover is a single panel.

14. The stringed musical instrument case of claim 12, the case body having a top and a bottom, the bottom positioned opposite the top, the musical instrument case further comprising a base fixed to the bottom of the case body for stabilizing the case body when the cover is moved to the musical instrument stand position.

15. A stringed musical instrument case, comprising:

a case body defining an internal cavity dimensioned for receipt of a stringed musical instrument;

a cover sized and shaped to cooperate with the case body to cover the internal cavity of the case body; and a hinge for hingedly connecting the cover to the case body, wherein rotation of the cover about the hinge moves the cover between an open and a closed position, wherein in the open position the cover supports the case body so that the case body defines a tilted musical instrument stand, wherein the closed position defines a musical instrument carrying position, the base comprising at least one extension member, slidably connected to the base, and movable relative thereto to, increase the stability of the case body when the cover is moved to the musical instrument stand position.

16. A stringed musical instrument case comprising:

a case body having a back and perimeter wall defining an internal cavity dimensioned for receipt of a stringed musical instrument, a cover sized and shaped to cooperate with the case body to cover the internal cavity of the case body; and a hinge for hingedly connecting the cover to the case body, the hinge having a hinge plate, wherein rotation of the cover about the hinge moves the cover between an open and a closed position, wherein in the open position, the hinge plate lies substantially adjacent to the back of the case body and the cover lies at an angle relative to the back of the case body.

17. A stringed musical instrument case comprising:

a case body having a back and perimeter wall defining an internal cavity dimensioned for receipt of a stringed musical instrument;

a cover sized and shaped to cooperate with the case body to cover the internal cavity of the case body; and a hinge for hingedly connecting the cover to the case body, the hinge having a hinge plate, wherein rotation of the cover about the hinge moves the cover between an open and a closed position, wherein in the open position, the hinge plate lies substantially adjacent to the back of the case body and the cover lies at angle relative to the back of the case body, the case body having a top, the top and the back meeting to form an edge; the cover having a top, the top having a plurality of edges therealong, one edge being substantially adjacent to the back of the case body when the cover is moved to the open position; the hinge comprising at least two axes of rotation, one axis of rotation substantially adjacent to the edge of the case body and the second axis of rotation substantially adjacent to the edge of the cover that is substantially adjacent to the back of the case body when the cover is moved to the open position.

18. The stringed musical instrument case of claim 17, the case body having a bottom, the case further comprising a base fixed to the bottom of the case body for stabilizing the case body when the cover is moved to the open position.

19. The stringed musical instrument case of claim 18, the base comprising at least one extension member, slidably connected to the base, and movable relative thereto to, increase the stability of the case body when the cover is moved to the open position.

20. A stringed musical instrument case comprising:

a case body defining an internal cavity dimensioned for receipt of an instrument, the case body having a back;

a cover sized and shaped to cooperate with the case body to cover the internal cavity of the case body; and a hinge for hingedly connecting the cover to the case body, the hinge having a hinge plate, wherein rotation of the cover about the hinge moves the cover between an open and a closed position, wherein in the open position, the hinge plate extends downward from the back of the case body at an acute angle relative to the back of the case body and the cover lies at an angle relative to the back of the case body.

21. The stringed musical instrument case of claim 20, the case body having a bottom, the case further comprising a base fixed to the bottom of the case body for stabilizing the case body when the cover is moved to the open position.

22. The stringed musical instrument case of claim 21, the base comprising at least one extension member, slidably connected to the base, and movable relative thereto to increase the stability of the case body when the cover is moved to the open position.

23. A stringed musical instrument case comprising:

a case body defining an internal cavity dimensioned for receipt of an instrument, the case body having a top, the case body top having a depth;

a cover sized and shaped to cooperate with the case body to cover the internal cavity of the case body, the cover having a top, the cover top having a depth; and a hinge for hingedly connecting the cover to the case body, the hinge having a hinge plate, the hinge plate having a length, wherein rotation of the cover about the hinge moves the cover between an open and a closed position, wherein in the closed position, the hinge plate has a length substantially equal to the combined depth of the top of the cover and the top of the case body.

24. The stringed musical instrument case of claim 23, the case body having a bottom, the case further comprising a base fixed to the bottom of the case body for stabilizing the case body when the cover is moved to the open position.

25. A stringed musical instrument case comprising:

a case body defining an internal cavity dimensioned for receipt of an instrument, the case body having a top, the case body top having a depth;

a cover sized and shaped to cooperate with the case body to cover the internal cavity of the case body; and a hinge for hingedly connecting the cover to the case body, the hinge having a hinge plate, the hinge plate having a length, wherein rotation of the cover about the hinge moves the cover between an open and a closed position, wherein in the closed position, the hinge plate has a length substantially equal to the depth of the top of the case body.

* * * * *